United States Patent [19]

Fremion

[11] 3,982,682

[45] Sept. 28, 1976

[54] CORNER POST

[75] Inventor: Edwin A. Fremion, West Alexandria, Ohio

[73] Assignee: Westvaco Corporation, New York, N.Y.

[22] Filed: Mar. 4, 1976

[21] Appl. No.: 663,996

[52] U.S. Cl. ..... 229/14 C; 206/320; 206/521

[51] Int. Cl.[2] ..... B65D 25/16

[58] Field of Search ..... 229/14 C; 206/521, 320, 206/326

[56] References Cited

UNITED STATES PATENTS

| | | | |
|---|---|---|---|
| 2,196,157 | 4/1940 | White | 229/DIG. 1 |
| 2,444,183 | 6/1948 | Cahners | 229/14 C UX |
| 3,221,973 | 12/1965 | Kalbrener | 229/14 C |
| 3,315,869 | 4/1967 | Rous | 229/14 C X |
| 3,613,985 | 10/1971 | Goodsite | 229/14 C |
| 3,708,101 | 1/1973 | McDanield | 206/521 |
| 3,734,389 | 5/1973 | Brown | 229/14 C |

FOREIGN PATENTS OR APPLICATIONS

| | | | |
|---|---|---|---|
| 642,838 | 9/1950 | United Kingdom | 206/320 |

*Primary Examiner*—Davis T. Moorhead

[57] ABSTRACT

An elongated corner post for use between the vertical corners of containers and products packaged therein consisting essentially of an integral rectangular tube and attached leg prepared from a single blank of paperboard or the like, said blank being of substantially rectangular configuration and divided along one of its dimensions by a plurality of parallel fold lines into a plurality of discrete panels of unequal width, at least two of said panels being arranged in overlapping engagement and secured to one another, the improvement wherein the formed corner post is normally stored and shipped in a substantially flat condition and manually erected into the tube and leg configuration at the point of use.

12 Claims, 7 Drawing Figures

CORNER POST

BACKGROUND OF INVENTION

The present invention relates to the field of packaging and more particularly, it relates to corner posts that are used in containers for the purpose of cushioning and protecting products shipped in the containers from damage caused by external forces.

It is customary to package bulky and heavy products in relatively lightweight but strong paperboard containers. However, during transportation, storage and handling of the packaged products the lightweight containers are subject to damage. Moreover, the vertical stacking strength of lightweight containers is not very great. Thus, damage can also occur to the packaged products when the containers are stacked high, either in a warehouse or in a transportation vehicle.

To overcome some of the problems inherent with lightweight containers, it is customary to add corner posts to the containers. When provided at the corners of a container, the corner posts provide excellent stacking strength, and because the corner posts provide a space between the side walls of the container and the packaged product, damage from external blows is substantially reduced.

DESCRIPTION OF PRIOR ART

The art of corner post design is well developed as represented by the disclosures of the following United States Pat. Nos.: 3,072,313; 3,613,985; 3,734,389; 3,780,929.

However, a careful analysis of the patented corner posts will show that most prior art designs take the form of completely formed structures that are hard to handle and store, or the form of unfinished blanks from which the corner posts are built on site. For instance, the FIG. 4 corner post disclosed in U.S. Pat. No. 3,072,313 is bulky to handle and store. Meanwhile, the corner posts disclosed in U.S. Pat. No. 3,613,985 require considerable labor to set up which is generally unacceptable to the customer.

In contrast to these prior efforts, the corner post of the present invention provides the user with a completely formed structure that needs only to be manipulated at the point of use to achieve its workable configuration. Moreover, the corner post of the present invention includes a provision wherein a part of the tubular portion thereof can be collapsed to clear handles, knobs or other projections on the surface of the packaged object.

SUMMARY OF INVENTION

The corner post of the present invention consists of an integral rectangular tube and leg prepared from a single blank of paperboard or the like with only two folds and a single glue lap. The leg portion of the corner post is arranged to fit between one of the side walls of the container in which it is used and the packaged product, while the tube portion of the corner post is arranged to fit into the corner of the container to provide a cushioning space between the packaged product and an adjacent side wall of the container.

Corrugated paperboard is the preferred material for the corner post blank and generally the blank is formed from several layers of paperboard (corrugated medium and linerboard) to produce a corner post of adequate strength. The corrugated material may be that conventionally used in forming containers or it may be impregnated or coated with a suitable moisture barrier material to resist the penetration of water. The corner post blank is divided by a plurality of fold lines (at least five) to produce a plurality of panels (at least six) each of which have different widths. The width of each individual panel may vary over a perscribed range but for the sake of the present invention, the variance in the width of each panel does not exceed a point which would prevent the folded and glued blank from being folded flat for shipment and storage. Thus, an important feature of the present invention lies in the fact that the fully assembled corner post can be folded flat for shipment to its point of use and then easily erected for use simply by manipulating the folded blank to form the rectangular tube portion of the corner post. Once the corner post is erected and inserted in a container between the container said ealls and the packaged product, it retains its shape as a result of being wedged into position. The corner post provides vertical stacking strength to the container both because of its shape and construction and also serves to provide a void space between the container side walls and the packaged product. Another important feature of the present invention is the provision whereby by applying selected cuts to the blank material, one or more parts of the erected tubular portion of the corner post can be collapsed to avoid knobs, handles or other projections on the packaged product.

DETAILED DESCRIPTION

Figure 1:
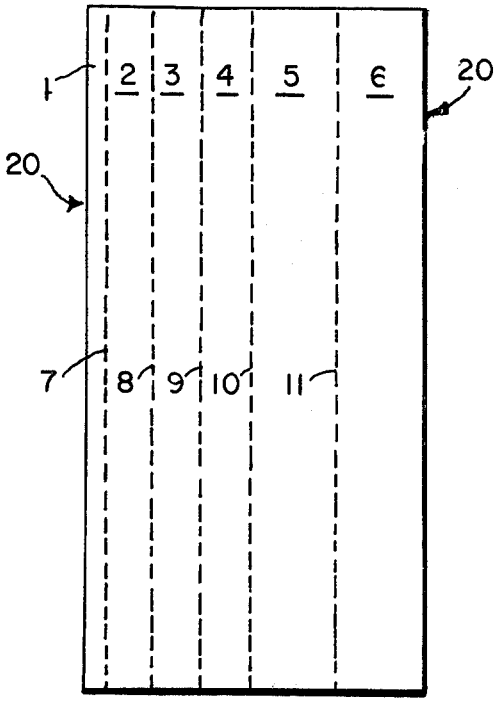
FIG. 1 shows in plan a typical blank structure for use in constructing the cornerpost of the present invention.
Figure 1A:
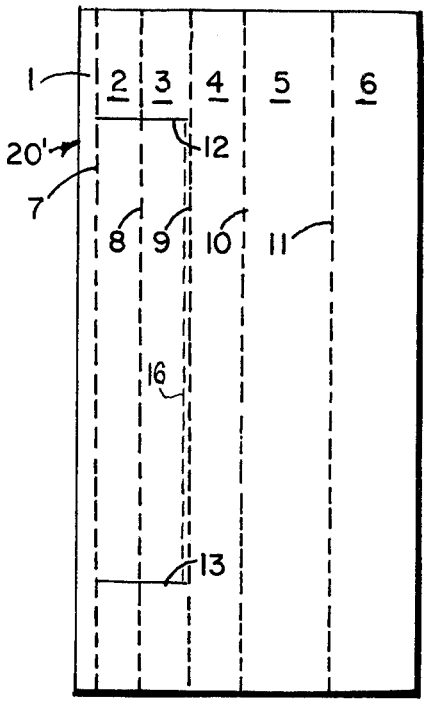
FIG. 1A shows a modified blank structure for the present invention.
Figure 2:
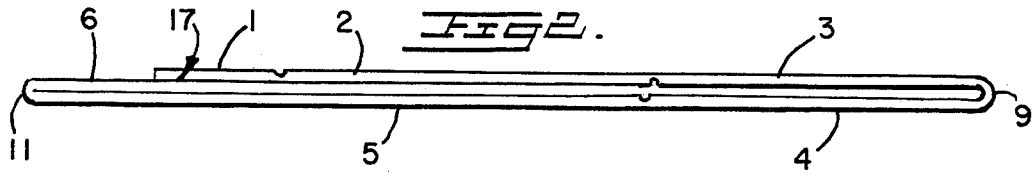
FIG. 2 shows an end view of the formed corner post in its flat condition.
Figure 3:
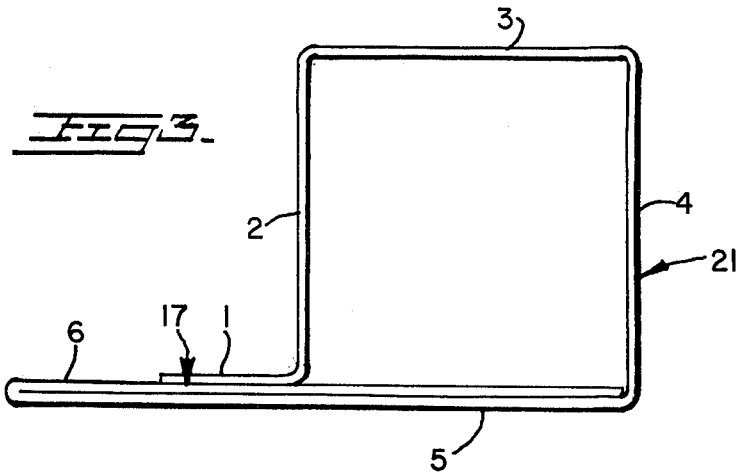
FIG. 3 shows an end view of the corner post in its useable configuration.
Figure 4:
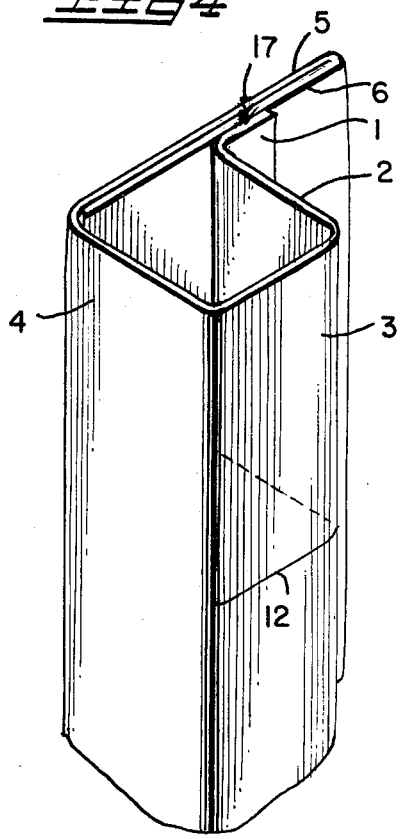
FIG. 4 is a perspective view of the corner post of FIG. 3 prepared from the blank of FIG. 1A.
Figure 5:
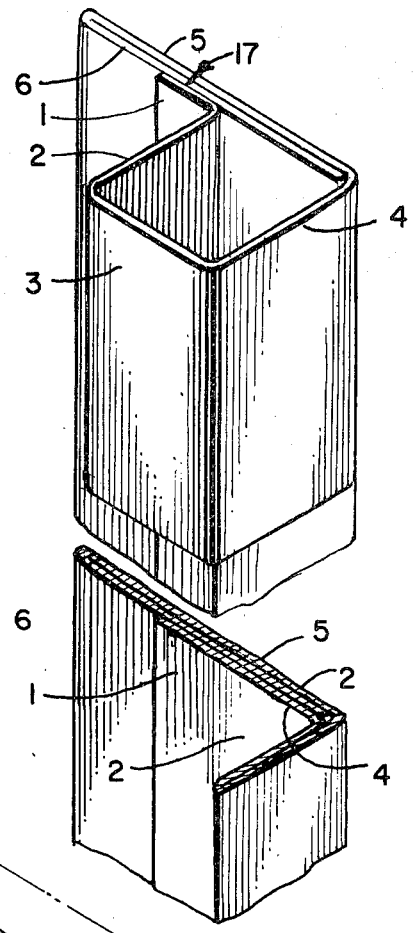
FIG. 5 is a perspective view of the corner post of FIG. 3 with a portion thereof collapsed; and, FIG. 6 is a perspective view of a container showing how a product packaged therein would be protected by the corner posts of the present invention.

Referring to the drawings, particularly FIGS. 1 and 1A, each illustrates a blank 20 of foldable sheet material, such as fiberboard, and more commonly multi-ply layers of corrugated paperboard, that can be used to fabricate the corner post of the present invention. The blank is of substantially rectangular configuration and is divided into a plurality of panels 1,2,3,4,5 and 6 by a series of parallel fold lines 7,8,9,10 and 11. The scored fold lines 8,9,10 and 11 are preferably applied to one face of the blank while score line 7 is applied to the opposite face of the blank to facilitate the folding sequence of the blank. In addition, it is preferred that score lines 9,10 and 11 consist of alternating cuts and scores (or indentations) to further facilitate folding particularly where the blanks are formed of several layers of corrugated paperboard. The scored fold lines each define the marginal edges of the corner post panels 2,3,4,5 and 6 and and a glue lap 1. A corner post is fabricated from the blanks of FIGS. 1 and 1A by first folding panel 6 about score line 11 to position panel 6 in face-to-face contact with panel 5. The two panels 5 and 6 can be adhered to one another but in the preferred embodiment they are simply held together by appropriate machinery well known in the trade. The next step in fabricating the corner post consists of applying a strip of adhesive 17 to the panel 6 in a predetermined location to align with glue lap 1. Subsequently, the group of panels 1,2,3 are folded over about fold line 9, and glue lap 1 is adhered to panel 6 to produce the collapsed corner post 21 as shown in FIG. 2. At this stage, the fabrication of the basic corner post is complete and it can be advantageously shipped to the user in the flattened condition for storage until used. Later, the corner post 21 is erected to its useable condition as shown in FIG. 3 by simply urging the two folds at 9 and 11 towards one another. When erected the corner post assumes a cross-sectional configuration substantially in the form of an integral rectangular tube (panels 2,3,4) and attached leg (panels 5,6).

The various panels of the blank 20 are preferably of unequal width in order that the blank can be folded into its flattened configuration for shipment and still be erected into a useable condition. As an example, a corner post three feet in length with an attached leg about 5 inches in width could be formed from a 3/16 inch thick blank measuring 36 inches by 19 15/16 inches. In this example, panel 6 would be about 4 13/16 inches wide, panel 5 about 5 inches wide, panel 4 and 3 ⅜ inches wide, panel 3 about 2 inches wide, and panel 2 about 3 inches wide and glue lap 1 about 1 ¾ inches wide. In designing the corner post 21 for a particular application the width of panel 5 is first determined. With the design width of panel 5 established panel 6 cannot have a maximum width any greater than the width of panel 5 less the thickness of the blank material. Meanwhile, the minimum width of panel 6 cannot be less than the width of panel 5 minus the width of panel 3. Similarly, the maximum dimension of glue lap 1 cannot be greater than the width of panel 5 minus the width of panel 3, and the minimum width of glue lap 1 cannot be too small or a good bond between glue lap 1 and panel 6 will not be achieved. Panels 2,3, and 4 which form the integral rectangular tube of the corner post, are sized as follows: the width of panel 4 is equal to the width of panel 2 plus the thickness of the blank material plus the outside gain produced by the fold 9 between panels 3 and 4. In addition, the width of panels 1,2 and 3 cannot exceed the width of panels 4 and 5 or the formed structure is difficult to collapse.

The blank is preferably die cut but other methods of manufacture could be used depending upon the desired configuration and ultimate use of the corner post. Where one or more portions of the tubular part of the corner post are to be collapsed, the cut lines 12 and 13 are applied to the panels 2,3 of the blank in a die cutting operation. The purpose of the collapsed sections of the corner post are to provide void areas in front of control knobs, handles or other projections on the packaged products to aid in collapsing portions of the corner post tube, and depending upon the thickness of the blank material, it is advisable to add double scores 9 and 16 in the regions to be collapsed between panels 3 and 4. The double scores are preferably spaced apart an amount that is substantially equal to the thickness of the blank material. Thus, as applied to the blank the scores 9 and 16 do not appreciably affect the folding sequence for forming the corner post and for flattening the post structure for shipment and storage. However, when the corner post tube is manipulated in order to collapse selected portions, the paired fold lines 9,16 in the collapsed region assure a smooth and efficient operation.

Figure 6:
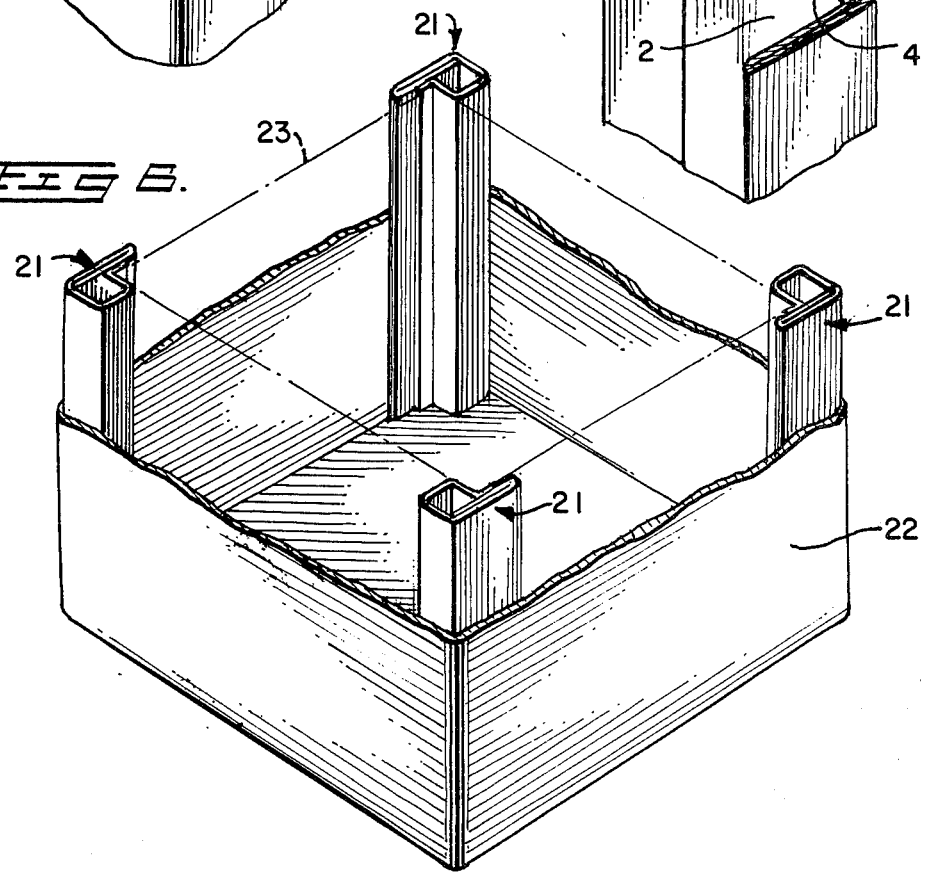

The corner posts of the present invention can be used several different ways. In some instances, the packaged product 23 is first placed in its shipping container 22 prior to insertion of the corner posts 21. FIG. 6 illustrates schematically a typical product 13 in a container 22 with corner posts 21 at each corner. In the instance where the corner posts 21 are inserted in the container after the packaged product, the posts must be inserted in such a manner that the uncollapsed portions of the tube do not have to clear any protruding parts of the packaged product. In other instances, where the product has handles or other projections that are spaced apart or located near the midpoint of the product, the corner posts 21 can be erected, portions thereof selectively collapsed, and then the corner posts can be fitted to the product and strapped in place. Later, the shipping container can be wrapped around the protected product or the product can otherwise be placed in its container.

It will be noted by those skilled in the art that the specification and drawing illustrate at least two embodiments of the present invention. Further, by practicing the disclosure set forth herein one could readily produce a corner post having a tubular part of any desired cross-sectional shape commensurate with the intended use. Moreover, where the packaged article had a plurality of handles, knobs or other projections, parts of the tubular portion could be made selectively collapsible by applying several spaced cuts in panels 2 and 3, to accommodate the product without imparing the function of the corner post. Other details of construction could also be altered without departing from the principles of the invention as defined in the appended claims.

I claim:

1. A corner post construction for use between the vertical corners of containers and products packaged therein consisting essentially of a corner post structure that is normally stored and shipped in a flat condition but when erected assumes a cross-sectional configuration substantially in the form of an integral rectangular tube and attached leg comprising:

a. a substantially rectangular blank of paperboard material or the like, scored along parallel fold lines to form a plurality of discrete panels of unequal width;

b. said blank being folded flat about at least two of said fold lines to bring at least two of said panels into overlapping engagement for the purpose of adhering said two panels together;

c. said flat folded blank being adapted to be erected into useable condition as a corner post by manipulating the folded blank to orient at least three contiguous panels into the tube portion of the corner post.

2. The corner post of claim 1 wherein the blank of paragraph (a) comprises at least six discrete panels, at least three of which lie in parallel planes to form the leg portion of said corner post in the erected condition.

3. The corner post of claim 2 wherein the leg portion comprises two primary panels, the first of which is adapted to contact a side wall of the container in which it is used.

4. The corner post of claim 3 wherein the second primary panel of said leg portion comprises one of the outside panels of said blank.

5. The corner post of claim 4 wherein the second primary panel of said leg portion has a maximum width no greater than the width of said first primary leg panel less the thickness of the blank material from which the corner post is formed, and a mimimum width no less than the width of the other outside panel of said blank.

6. The corner post of claim 5 wherein the tube portion comprises three connected primary panels, two of which lie in spaced apart substantially parallel planes, the first of which abuts the product packaged in the container and the second of which is adapted to contact a side wall of the container in which it is used, and the third primary panel comprises a bridging panel between the two spaced apart substantially parallel primary panels.

7. The corner post of claim 6 wherein the first and second primary tube portion panels are substantially equal in width.

8. The corner post of claim 7 wherein the width of the second tube portion primary panel is equal to the width of the first tube portion primary panel plus twice the thickness of the blank material from which the corner post is formed.

9. The corner post of claim 8 wherein the width of the second primary panel of the leg portion of said corner post is greater than the width of the first primary panel of the leg portion less the width of the third primary panel of said tube portion.

10. The corner post of claim 9 wherein the combined width of the first primary panel of said leg portion and the second primary panel of said tube portion is greater than the combined width of the third primary panel of said tube portion, the first primary panel of said tube portion and the outside panel adhered to the second primary panel of said leg portion.

11. The corner post of claim 10 wherein the first and third panels of said tube portion each contain at least one full width cut substantially perpendicular to the fold line connecting the two panels.

12. The corner post of claim 11 wherein a part of the tube portion of said corner post is collapsed adjacent the full width cut in the first and third panels of said tube portion.

* * * * *